US008403715B1

(12) United States Patent
Arneson

(10) Patent No.: US 8,403,715 B1
(45) Date of Patent: Mar. 26, 2013

(54) MARINE JET DRIVE

(76) Inventor: Howard M. Arneson, San Rafael, CA (US)

( * ) Notice: Subject to any disclaimer, the term of this patent is extended or adjusted under 35 U.S.C. 154(b) by 0 days.

(21) Appl. No.: 13/312,833

(22) Filed: Dec. 6, 2011

(51) Int. Cl.
*B63H 11/103* (2006.01)

(52) U.S. Cl. ..... 440/47; 440/38

(58) Field of Classification Search ..... 440/38, 440/40, 41, 42, 47; 114/151
See application file for complete search history.

(56) References Cited

U.S. PATENT DOCUMENTS

| | | | | |
|---|---|---|---|---|
| 2,985,133 | A | 5/1961 | Shaffer | |
| 3,105,353 | A | 10/1963 | Schulz | |
| 3,207,116 | A * | 9/1965 | France | 440/41 |
| 3,212,258 | A | 10/1965 | Gongwer | |
| 3,336,752 | A | 8/1967 | Smith | |
| 3,455,268 | A | 7/1969 | Gordon | |
| 3,742,895 | A | 7/1973 | Horiuchi | |
| 3,768,432 | A | 10/1973 | Spaulding | |
| 3,793,980 | A | 2/1974 | Sherman | |
| 3,933,116 | A | 1/1976 | Adams et al. | |
| 4,031,846 | A | 6/1977 | Tone | |
| 4,073,257 | A | 2/1978 | Rodler, Jr. | |
| 4,281,996 | A | 8/1981 | Mouraret et al. | |
| 4,325,699 | A * | 4/1982 | Castoldi | 440/47 |
| 4,373,919 | A * | 2/1983 | Stangeland | 440/47 |
| 4,437,841 | A | 3/1984 | Stallman | |
| 4,538,996 | A | 9/1985 | Inwood | |
| 4,544,362 | A | 10/1985 | Arneson | |
| 4,645,463 | A | 2/1987 | Arneson | |
| 4,746,314 | A | 5/1988 | Levi | |
| 4,808,132 | A | 2/1989 | Douglas | |
| 4,909,175 | A | 3/1990 | Arnseson | |
| 5,066,255 | A | 11/1991 | Sand | |
| 5,207,605 | A | 5/1993 | Kroeber | |
| 5,240,444 | A * | 8/1993 | Kobayashi et al. | 440/41 |
| 5,270,605 | A | 12/1993 | Lefrancois et al. | |
| 5,667,415 | A | 9/1997 | Arneson | |
| 6,059,618 | A | 5/2000 | Purnell et al. | |
| 7,220,154 | B2 | 5/2007 | Lawson | |
| 7,335,074 | B2 | 2/2008 | Arneson | |

FOREIGN PATENT DOCUMENTS

DE 3042197 A1 6/1982

OTHER PUBLICATIONS

Doen Water Jets 100 and 200 series specification sheets; Doen Waterjets Pty Ltd; downloaded from www.doen.com prior to Dec. 6, 2011; 2 pages.

* cited by examiner

*Primary Examiner* — Lars A Olson
(74) *Attorney, Agent, or Firm* — James F. Hann; Haynes Beffel & Wolfeld LLP

(57) ABSTRACT

A marine jet drive, for a boat having a transom and a drive shaft extending through the transom, the boat afloat in a water body, includes a support casing disposed aft of the transom and a pump shaft within the support casing, the pump shaft having an end connectable to the drive shaft. The jet drive includes a jet pump having a chamber and a blade coupled to a portion of the pump shaft extending into the chamber. The chamber is attached to and supported by the support casing aft of the support casing. The chamber has an inlet for receiving water into the chamber and an outlet. The blade is coupled to the portion of the pump shaft for co acting with the chamber to draw water into the chamber inlet and discharge water in a reactive jet out the chamber outlet to reactively propel the boat.

13 Claims, 5 Drawing Sheets

MARINE JET DRIVE

BACKGROUND OF THE INVENTION

Jet pumps are previously known for the propulsion of high-speed watercraft. In one type of installation, the hull of the watercraft is provided with an inlet aperture through the bottom of the hull adjacent to the transom. An axial or centrifugal pump takes suction through the inlet and discharges the water to a pressure chamber. The pressure chamber outlets an airborne jet of water. The resulting reactive force provides propulsion to the high-speed boat. Deflectors are typically mounted to the jet pump and are used to change the direction of the airborne jet of water thus altering the reactive force of the jet to steer the boat. Deflectors are commonly used to redirect the jet of water in a forward direction allowing the boat to back up. See, for example, the following U.S. Pat. Nos. 7,220,154; 4,073,257; and 3,336,752; the disclosures of which are incorporated by reference.

It is also known to provide jet pumps to outboard motors. Typically, a pump inlet is provided at the bottom of the motor adjacent to the surface of the water. The inlet communicates to an axial or centrifugal pump which discharges to an outboard motor-mounted pressure chamber. The pressure chamber discharges an airborne water jet at an outlet of a outboard motor. The reactive force acting on the outboard is commonly used to propel a small watercraft, typically at high speeds or in shallow water conditions. See, for example, the following U.S. Pat. Nos. 4,538,996; 4,281,996; and 3,105,353; the disclosures of which are incorporated by reference.

In my U.S. Pat. No. 4,645,463 entitled Marine Outdrive Apparatus, I disclosed marine outdrive attached to the transom of a boat having an inboard engine. The marine outdrive includes a tubular support casing securable to and extendable rearwardly of the boat's transom and having a ball socket at its rear end. The ball socket receives a ball at the front end of a tubular, propeller shaft carrier. A drive shaft connectable to the inboard engine is journaled in the support casing. A propeller shaft is journaled in the propeller shaft carrier and has a propeller mounted thereon at the rear end of the propeller shaft carrier. The propeller shaft transmits thrust to the ball at a conical thrust bearing. A double Cardan joint—sometimes called a universal joint—couples the two shafts together to transmit torque between the shafts, the center of such joint substantially coinciding with the point about which the ball pivots within the ball socket. Hydraulic steering cylinders are attached to the propeller shaft carrier to pivot the latter about a steering axis extending through the pivot point of the ball. A hydraulic trim cylinder extends between the transom and the propeller shaft carrier to swing the propeller shaft carrier about a laterally extending trim axis extending through the pivot point of the ball. The upper end of the trim cylinder is pivotally mounted on the transom at a location above and vertically aligned with the pivot point of the ball or at a location above and forwardly of such pivot point. Improved fins are provided on the propeller shaft carrier near the propeller to stabilize the boat. The drive shaft of the inboard motor can be directly connected to the joint or offset from the joint and coupled thereto by a vertically extending transmission.

BRIEF SUMMARY OF THE INVENTION

A marine jet drive, for a boat having a transom and a drive shaft extending through the transom, the boat afloat in a water body, includes a support casing disposed aft of the transom and a pump shaft within the support casing, the pump shaft having an end connectable to the drive shaft. The jet drive includes a jet pump having a chamber and a blade coupled to a portion of the pump shaft extending into the chamber. The chamber is attached to and supported by the support casing aft of the support casing. The chamber has an inlet for receiving water into the chamber and an outlet. The blade is coupled to the portion of the pump shaft for co acting with the chamber to draw water into the chamber inlet and discharge water in a reactive jet out the chamber outlet to reactively propel the boat. In one embodiment, the tubular support casing extends from a ball socket and power source connect shaft at the boat transom. The ball socket at the transom captures the ball and permits the tubular support casing to be adjustable in orientation in two directions of freedom about the ball socket. A double Cardan joint substantially coincident to the center of pivot of the ball and ball socket transmits torque between the power source shaft and drive shaft in the tubular support casing. At least one hydraulic trim cylinder extends between the transom and the tubular support casing to orient the jet pump through the pivot point of the ball. In operation, by adjustment of the tubular support casing and contained shaft, variable orientation of the jet pump at its intake and outlet is achieved allowing dynamic optimization of jet pump orientation relative to boat trim behind the boat transom during jet pump operation.

Over a conventional jet drive, the tubular support casing containing the drive shaft extending beyond the transom forms the sole support to the chamber. In some embodiments, the chamber is thus supported by the tubular support casing in the water body astern of the transom with both the chamber inlet and outlet of the jet pump disposed behind the transom.

In an embodiment, the marine jet drive may also have two dynamic positioning cylinders for moving the marine jet drive relative to the transom to allow for changes in the vertical and horizontal orientation of the marine jet drive in two directions of freedom. This enables movement of the marine jet drive to both change orientation of the pump with respect to the trim of the boat and allow jet pump side to side movement to provide an assist to boat steering.

In the prior art, water is transported from the water body to the jet drive in the boat. Here, the jet drive is moved to the water body from the boat. Change of jet drive immersion can occur with change of boat trim as the boat hull moves from standing displacement immersion in the water body to plane over the top of the water body. Further, the suspension of the jet drive augments jet drive boat steering. While conventional jet drives provide for boat steering by using steering deflectors at the discharging jet, the present jet drive can steer the entire immersed jet drive while still using standard deflectors. There results a jet drive having enhanced maneuvering characteristics compared to conventional jet drives.

The chamber may be flanked by fins or side panels adjacent the inlet. Dependent upon chamber orientation, these fins or side panels may serve to crowd water into the inlet during boat operation. In an additional embodiment, there may also be a scoop positioned proximate the water inlet opening. It has been discovered that performance can be improved by dynamically adjusting the flow of water into the jet pump intake. Such adjustment of water flow into the jet pump intake, such as through the change in orientation of the scoop, can typically be in response to the vertical orientation, or elevation, of the jet pump and the boat speed. The scoop can be individually adjustable with respect to the chamber.

Other features, aspects and advantages of the present invention can be seen on review of the figures, the detailed description, and the claims which follow.

DETAILED DESCRIPTION OF THE INVENTION

Figure 1:
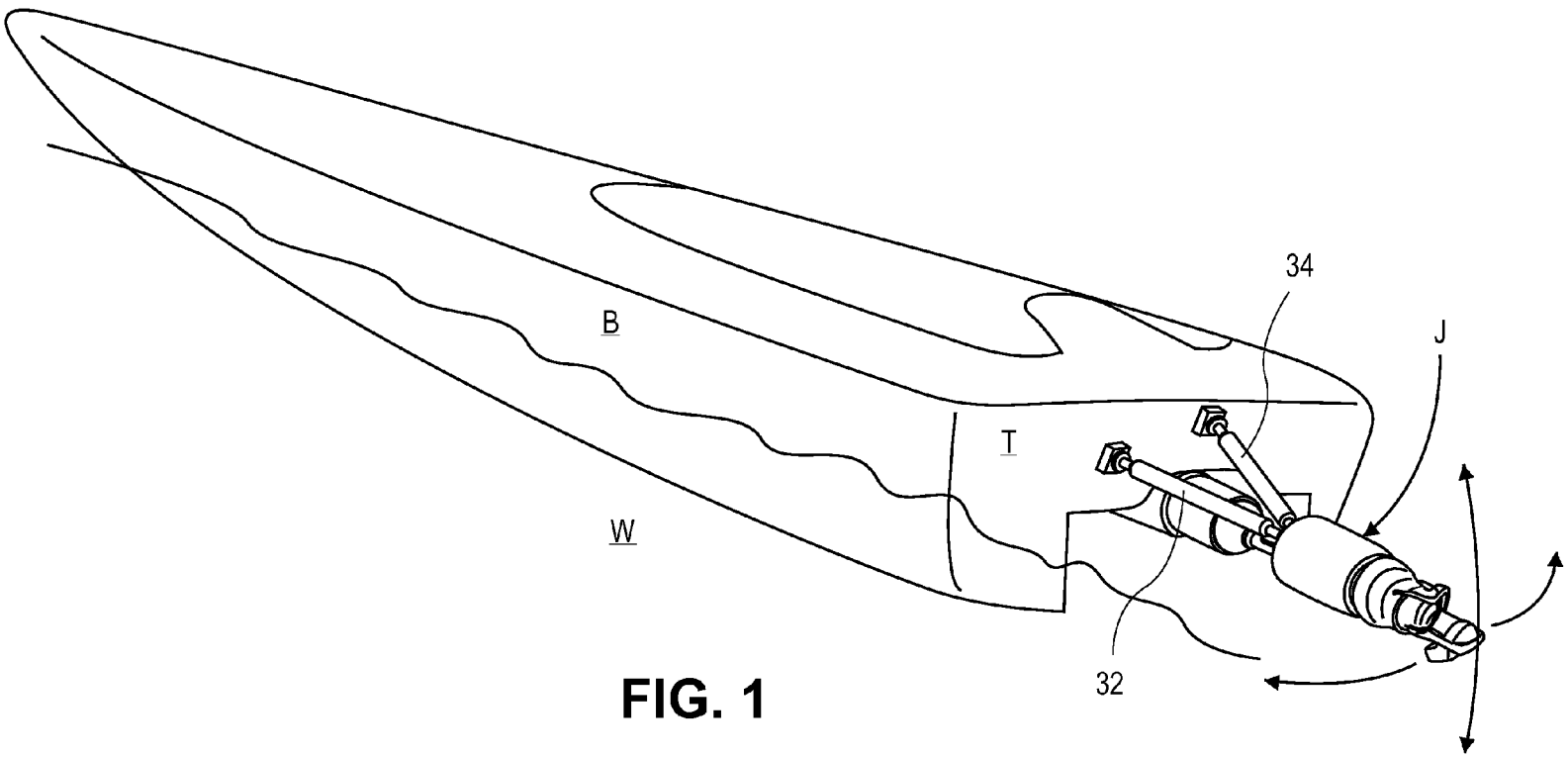
FIG. 1 illustrates a perspective top port side view of a boat having a transom and a marine jet drive mounted to and extending aft of the transom with arrows demonstrating possible movements of the jet drive with respect to the boat.

The following description will typically be with reference to specific structural embodiments and methods. It is to be understood that there is no intention to limit the claims to the specifically disclosed embodiments and methods but that the claims may be practiced using other features, elements, methods and embodiments. Preferred embodiments are described to illustrate, not to limit the claims. Those of ordinary skill in the art will recognize a variety of equivalent variations on the description that follows. Like elements in various embodiments are commonly referred to with like reference numerals.

Referring to FIG. 1, marine jet drive J is intended for use with a boat B afloat in a water body W. With additional reference to FIG. 2, boat B has a transom T and a drive shaft S and tubular support casing C extending outwardly from the transom in the aft direction. Drive shaft S is contained within tubular support casing C (see FIGS. 1 and 2). Jet pump P has a pump chamber 14 fastened to the distal end of the tubular support casing C remote from the boat. The pump chamber has an inlet 16 for receiving water and an outlet 18 for discharging a jet of water 20 for reactive propulsion of the boat, both pump chamber inlet and outlet being behind the boat transom. A pump impeller 22 within the chamber 14 is driven by the drive shaft S. The pump impeller 22 coacts with the chamber 14 to impel water from the chamber inlet 16 to the chamber outlet 18 to produce the jet 20 that reactively drives the boat. Jet pump P could be another type of axial pump, such as one using a propeller instead of an impeller. Also, impeller 22 could be a mixed flow impeller. In some examples, the blade is a propeller blade in which the tip of the propeller blade is trimmed off to lie close to the inner surface of chamber 14.

Figure 2:
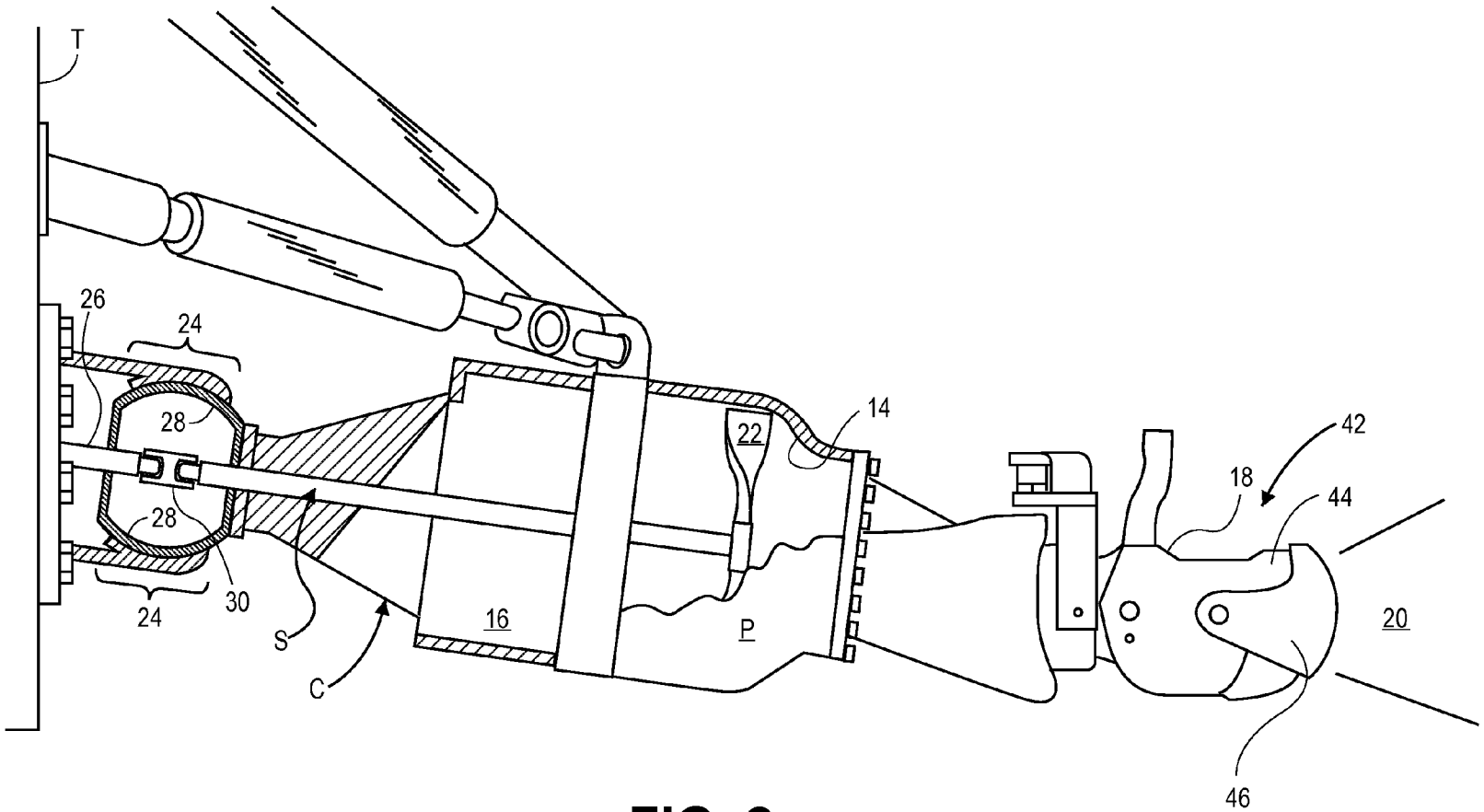
FIG. 2 is a section taken through the structure of FIG. 1 illustrating the ball socket, the power source connected shaft, the ball captured within the socket, the tubular support casing extending from the ball, the drive shaft within the tubular support casing, the chamber fastened to and supported by the tubular support casing, the chamber inlet, the chamber outlet, and shaft driven pump within the chamber.

In the embodiment shown here in FIG. 2, the tubular support casing C extends from a ball socket 24 and power source connect shaft 26 at the boat transom T. The ball socket 24 at the transom captures tubular support casing ball 28 and permits the tubular support casing C to be adjustable in orientation in two directions of freedom about the ball socket 24. A double Cardan joint 30 substantially coincident to the center of pivot of tubular support casing ball 28 and ball socket 24 transmits torque between the power source drive shaft and pump shaft in the tubular support casing. Thrust from the jet pump J to boat B occurs solely through tubular support casing ball 28 and ball socket 24.

Figure 3:
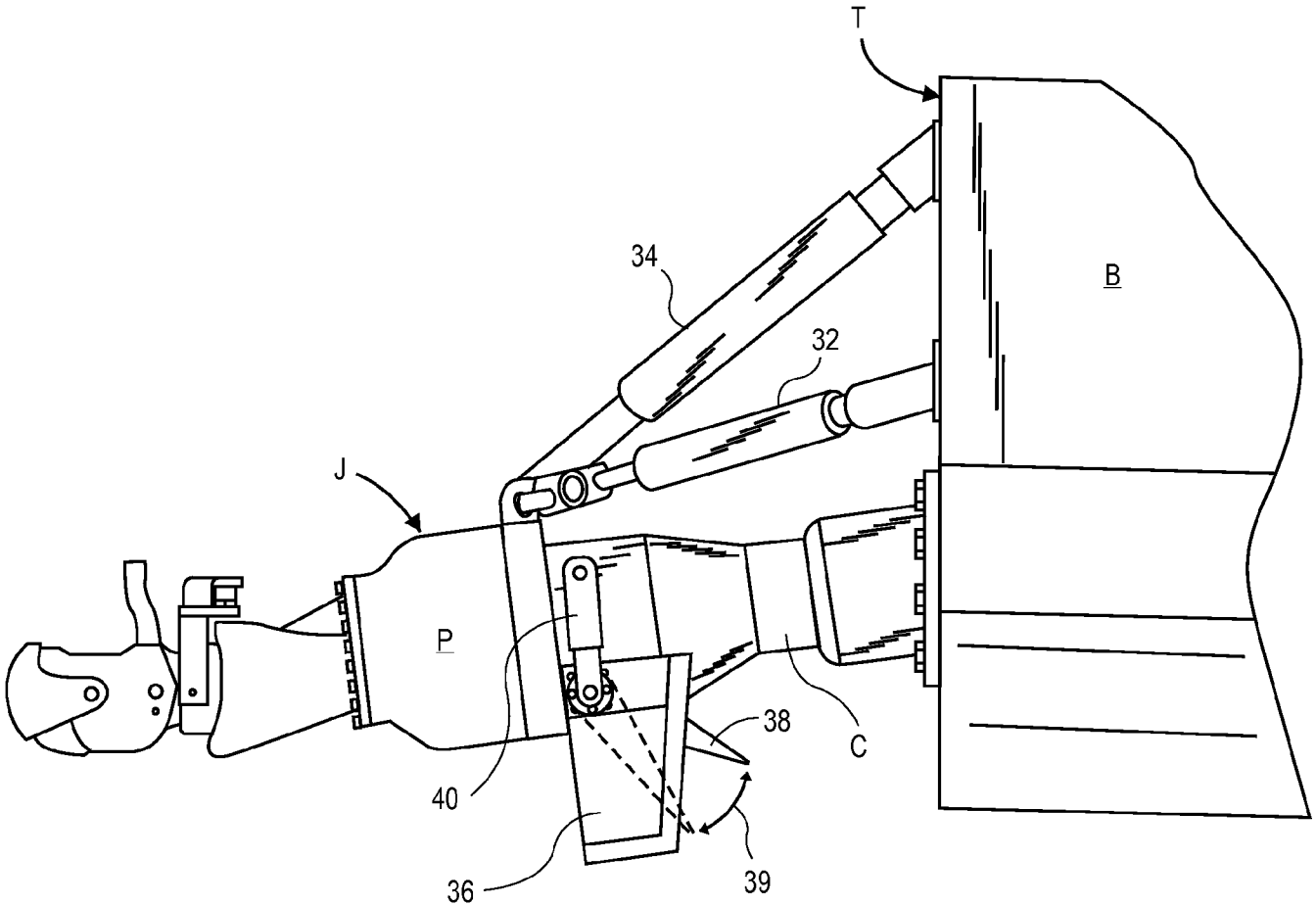
FIG. 3 is an enlarged starboard side view of another embodiment of a marine jet drive similar to that of FIG. 1 but including an adjustable scoop and a pair of downwardly extending fins on the sides of the scoop.

Referring to FIGS. 2 and 3, provision is made for movement of the marine jet drive J relative to transom T. At least one hydraulic trim cylinder 32 extends between the transom T and the tubular support casing C to orient the jet pump P through the pivot point of ball socket 24 and tubular support casing ball 28. Preferably, there is a second hydraulic trim cylinder 34 which in extension with hydraulic cylinder 32 orients jet pump P relative to transom T. In addition to hydraulic trim cylinders, other types of trim actuators can also be used. This enables movement of the marine jet drive to both change orientation of the pump with respect to the trim of the boat through trim cylinder 34 and allow jet pump side to side movement through trim cylinder 32 to provide an assist to boat steering. Examples of dynamic positioning apparatus are shown used with surface piercing propeller drives in the inventor's U.S. Pat. No. 7,335,074 and the patents cited therein, the disclosure of which is incorporated by reference.

Outlet 18 is created at a discharge assembly 42 including a discharge nozzle 44 which can be moved side to side for steering. Discharge nozzle 44 emits water jet 20 to provide propulsion for boat B. Jet discharge assembly 44 may also include a reverse thrust deflector 46 that can be pivoted downwardly to allow boat B to move in reverse. Jet discharge assembly 42 may also include additional steering deflectors. The operational lines and cables used to steer jet discharge assembly 42 and operate reverse thrust deflector 46 are not shown for clarity of illustration. The construction of jet discharge assembly 42 can be conventional. Jet discharge assemblies 42 are typically sold as portions of conventional watercraft waterjets such as those made by Doen Waterjets PTY LTD of Victoria, Australia.

Figure 4:
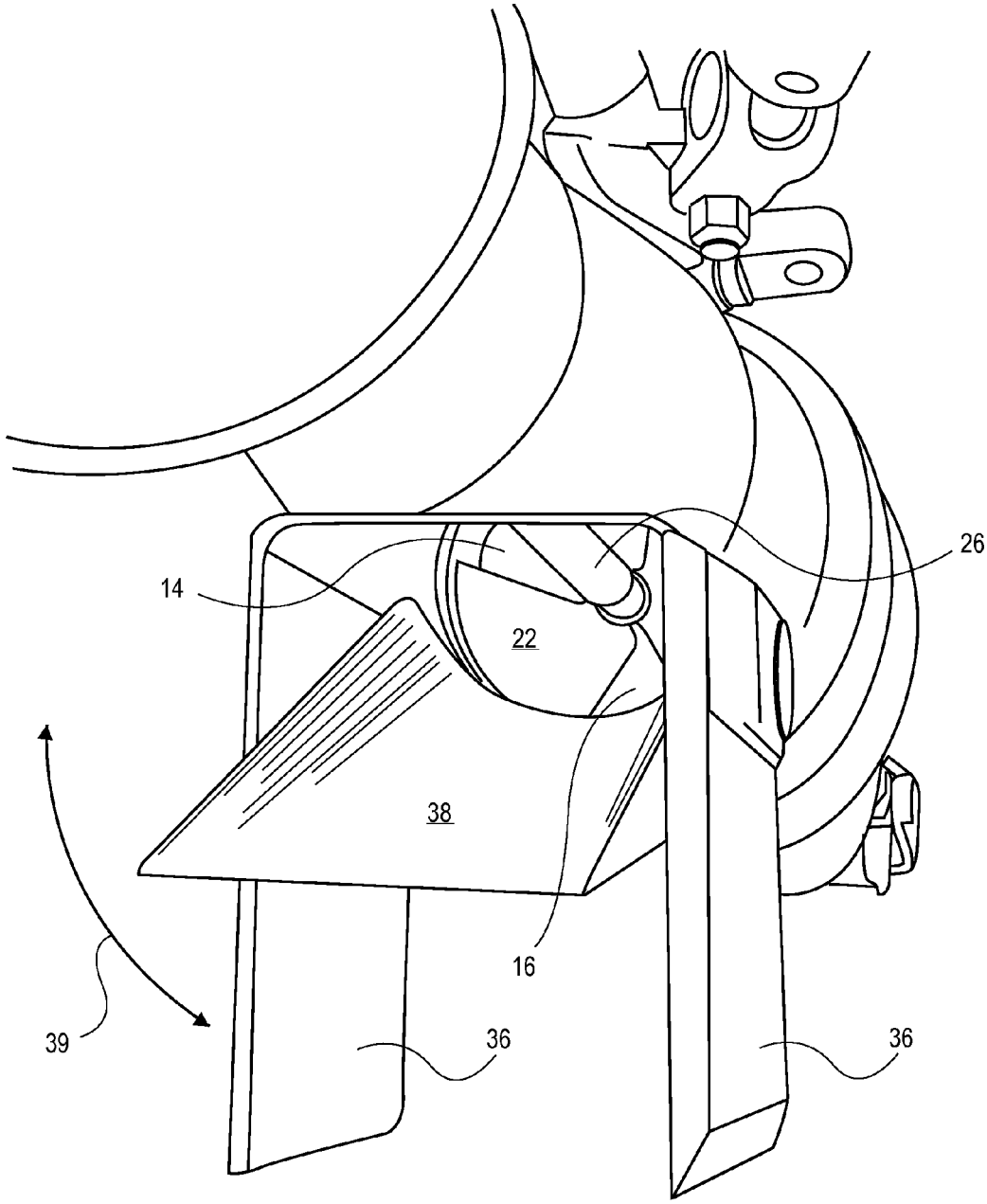
FIG. 4 illustrates perspective view of the underside of the novel jet pump chamber of the embodiment of FIG. 3 showing the fins on either side of the chamber inlet, the fins here being parallel, extending vertically down into the water, and the jet drive being canted with respect to boat motion to crowd water into the inlet when the chamber moves through the water body, this embodiment also showing a scoop in the vicinity of the chamber inlet and between the fins, the scoop here shown being adjustable relative to the inlet to optimally meter water into the chamber of the jet drive.

Referring to the view of FIG. 4, chamber 14 at inlet 16 may be flanked by fins 36 adjacent the inlet 16. With chamber orientation slightly depressed relative to the surface of water body W, these fins 36 serve to crowd water into the inlet during boat operation. Fins 36 in FIG. 4 are shown depending vertically downward relative to jet pump P. There may also be a scoop 38 positioned proximate the inlet 16. The scoop may either be fixed or individually adjustable with respect to the chamber 14. As indicated by arrow 39 in FIG. 3, scoop 38 is adjustable through hydraulically actuated lever 40. The actuator for lever 40 is not illustrated for clarity of illustration.

Figure 5:
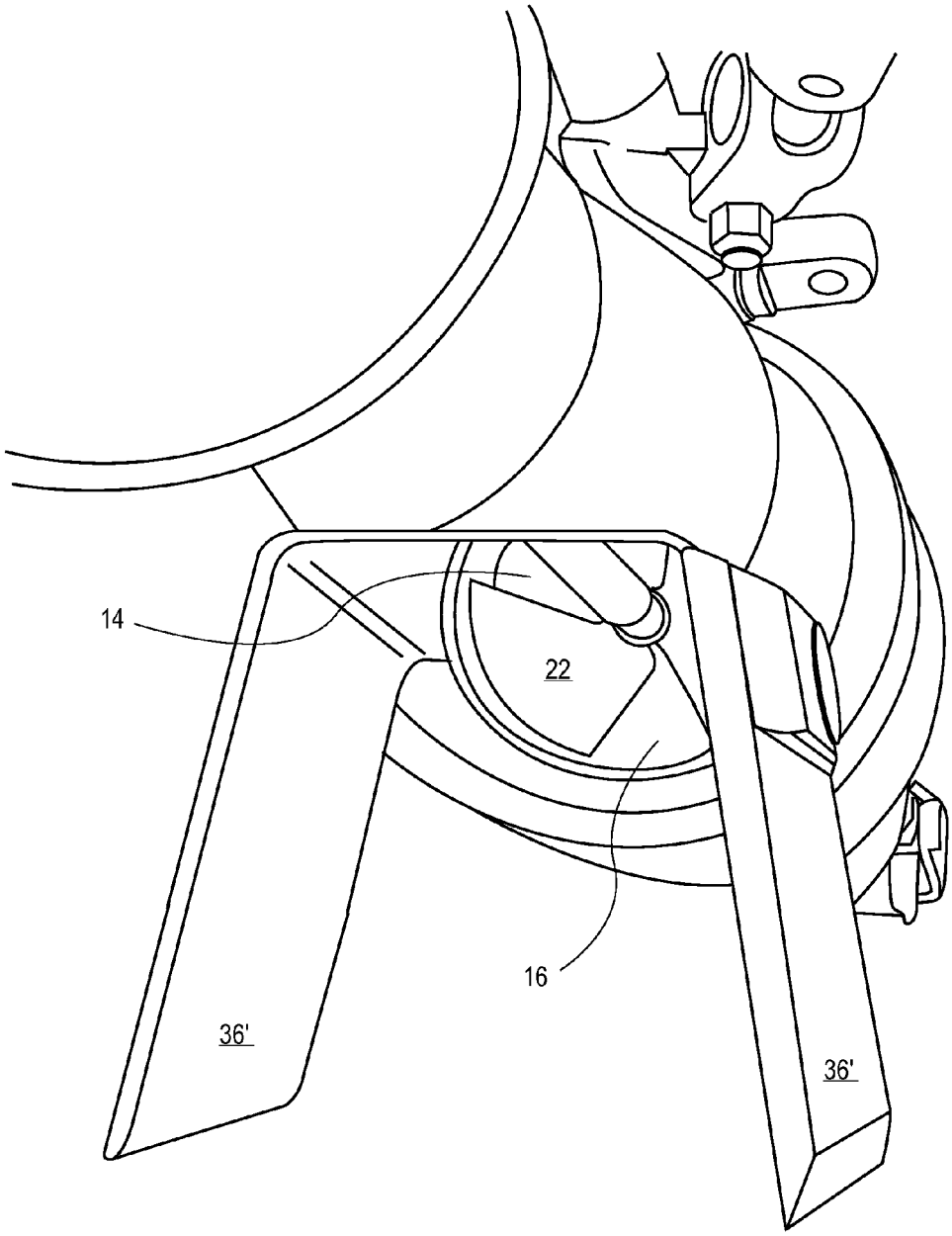
FIG. 5 illustrates a perspective view similar to FIG. 4 of another embodiment without the scoop but with fins flared downwardly and outwardly from the vertical and inwardly in the aft direction to direct water into the pump chamber opening.

Referring to FIG. 5, fins 36' may be other than vertical. Here fins 36' are shown flared outward from inlet 16 at angles ranging between about 15-20° from vertical. Again, this flaring together with the orientation of jet pump P allows water to be crowded into the inlet 16 of jet pump P. Fins 36' also converge in the aft direction to define an included angle of about 40°.

In operation, by adjustment of the tubular support casing C and contained shaft S using trim cylinders 32, 34, variable orientation of the jet pump J at its inlet 16 and outlet 18 is achieved allowing dynamic optimization of jet pump orientation relative to boat trim behind the boat transom T during jet pump operation.

One of the primary advantages of some examples of the invention is the improvement in performance provided by the ability to dynamically adjust the vertical orientation of marine jet drive J and the angular inclination of scoop 38. This provides the operator with the ability to make a change to the vertical orientation of marine jet drive J, or the angle of scoop element 38, or both, and to achieve substantially immediate feedback based upon the changes. This permits the user to place marine jet drive J at an optimal orientation depending on the particular operating conditions, including the speed of boat B and the load within the boat.

The tubular support casing C containing the drive shaft S extending beyond the transom T forms the effectively sole support to the jet pump P. Trim cylinder 34 typically provides only a small portion of the vertical support to prevent the downward pivotal movement of jet pump P when at rest. Trim cylinder 34 may act to prevent the upward inclination of jet pump J when moving at higher speeds. The chamber 14 is thus effectively supported by the tubular support casing C in the water body W astern of the transom T with both the chamber inlet 16 and outlet 18 of the jet pump disposed behind the transom.

In an aspect, this disclosure describes an improvement in a marine jet drive for a boat. Among others, the improvement in the marine jet drive eliminates the need for an opening in the hull for water intake to the marine jet assembly. In an embodiment, the marine jet drive has a jet pump that includes a chamber with an inlet for providing water to the marine jet drive. The chamber inlet provides the sole source of water for the jet pump, eliminating the need for water intake through the boat hull and for passing the water back to the marine jet drive rotating blades.

Another improvement in marine jet drives disclosed herein is the selection of the blades for an axial pump that turn at the same speed as the power source connected drive shaft thereby eliminating the need for a transmission to convert the drive shaft speed into a rotational speed compatible with the blade design.

This disclosure also illustrates that the marine jet drive may be equipped with a dynamic positioning apparatus that provides for adjusting the vertical orientation of the marine jet drive so that the jet pump chamber inlet can be movably positioned relative to the water body, allowing for control of the water intake flow depending upon changing boat trim during startup and speed operation. Other improvements and enhancements will be discussed below with regard to particular components or features.

Examples of boats B with marine jet drives J have another advantage over conventional marine jet drives. During turning, especially hard turns, the operator can orient marine jet drive J to ensure that it remains in a properly submerged state relative to water body W. This is not possible with conventional marine jet drive mounted beneath the hull of the boat.

Further, the buoyancy of the hull is minimally affected by water within the jet pump P as the entire marine jet drive J is maintained outside the floating hull of boats B. This is in contrast with conventional jet drive boats which can see an increase in the weight of the boat by 10% or more because of the water drawn into the jet drive apparatus within the hull of the boat.

While the present invention is disclosed by reference to the preferred embodiments and examples detailed above, it is to be understood that these examples are intended in an illustrative rather than in a limiting sense. It is contemplated that modifications and combinations will occur to those skilled in the art, which modifications and combinations will be within the spirit of the invention and the scope of the following claims.

What is claimed is:

1. A marine jet drive for a boat having a transom and a drive shaft extending through the transom, the boat afloat in a water body, the marine jet drive comprising:

a support casing disposed aft of the transom and a shaft within the support casing, the shaft having an end connectable to the drive shaft;

a jet pump comprising a chamber and a blade coupled to a portion of the shaft extending into the chamber;

the chamber attached to and supported by the support casing aft of the support casing, the chamber having an inlet for receiving water into the chamber and an outlet;

the blade being coupled to the portion of the shaft for co-acting with the chamber to draw water into the chamber inlet and discharge water in a reactive jet out the chamber outlet to reactively propel the boat; and first and second fins extending downwardly and outwardly from the bottom surface of the chamber adjacent to the inlet, the fins being separated from one another, the fins having upper ends adjacent to the chamber and lower ends spaced apart from the chamber, the separation between the lower ends being greater than the separation between the upper ends.

2. The marine jet drive of claim 1, further comprising:

a ball at the boat transom with the support casing secured to and extending from the ball;

a ball socket at the transom defining a pivot point, the ball socket being supported by the transom, the ball socket capturing the ball and permitting the drive shaft and support casing to be adjustable in orientation about the pivot point.

3. The marine jet drive of claim 2, further comprising a universal joint at the end of the shaft located generally at the pivot point.

4. The marine jet drive of claim 2, further comprising:

at least one hydraulic trim cylinder extending between the transom and at least one of the support casing and the chamber to orient the jet pump through the pivot point of the ball for adjustment of the support casing and the shaft, whereby variable orientation of the jet pump at its intake and outlet can occur allowing dynamic optimization of jet pump orientation relative to boat trim behind the boat transom during jet pump operation.

5. The marine jet drive of claim 4, further comprising first and second trim actuators extending between the transom and said at least one of the support casing and the chamber to orient the jet pump through the pivot point in two directions of freedom.

6. The marine jet drive assembly of claim 1, wherein the fins extend from the chamber at respective angles ranging between 15-20 degrees from vertical.

7. The marine jet drive assembly of claim 1, wherein a rotational speed of the shaft is the same as the rotational speed of the drive shaft.

8. The marine jet drive assembly of claim 1, wherein the blade is a mixed flow impeller.

9. The marine jet drive assembly of claim 1, wherein the blade is a trimmed down propeller.

10. The marine jet drive assembly of claim 1, wherein the chamber is attached directly to the support casing.

11. A marine jet drive for a boat having a transom and a drive shaft extending through the transom, the boat afloat in a water body, the marine jet drive comprising:

a support casing disposed aft of the transom and a shaft within the support casing, the shaft having an end connectable to the drive shaft;

a jet pump comprising a chamber and a blade coupled to a portion of the shaft extending into the chamber;

the chamber attached to and supported by the support casing aft of the support casing, the chamber having an inlet for receiving water into the chamber and an outlet;

the blade being coupled to the portion of the shaft for co-acting with the chamber to draw water into the chamber inlet and discharge water in a reactive jet out the chamber outlet to reactively propel the boat;

first and second fins extending downwardly and outwardly from the bottom surface of the chamber adjacent to the inlet, the fins being separated from one another, the fins having upper ends adjacent to the chamber and lower ends spaced apart from the chamber, the separation between the lower ends being greater than the separation between the upper ends; and an adjustable position scoop positioned proximate the inlet of the chamber.

12. The marine jet drive assembly of claim 11, wherein the scoop is positioned between the first and second fins.

13. A boat afloat in a water body comprising:

a hull with a stern transom;

a power source within the hull for powering a drive shaft extending through the transom;

a support casing disposed aft of the transom and a shaft within the support casing, the shaft having an end connected to the drive shaft at a position aft of the transom;

a jet pump comprising a chamber and a blade coupled to a portion of the shaft extending into the chamber;

the chamber attached to and supported by the support casing aft of the support casing, the chamber having an inlet for receiving water into the chamber and an outlet;

the blade being coupled to the portion of the shaft for co-acting with the chamber to draw water into the chamber inlet and discharge water in a reactive jet out the chamber outlet to reactively propel the boat;

a ball at the boat transom with the support casing extending from the ball;

a ball socket at the transom capturing the ball and permitting the drive shaft and support casing to be adjustable in orientation about a pivot point of the ball socket;

the ball socket defining a pivot point;

a universal joint at the end of the shaft located generally at the pivot point;

first and second trim actuators extending between the transom and at least one of the support casing and the chamber to orient the jet pump through the pivot point of the ball in two directions of freedom for adjustment of the support casing and the shaft, whereby variable orientation of the jet pump at its intake and outlet can occur allowing dynamic optimization of jet pump orientation relative to boat trim behind the boat transom during jet pump operation; and first and second fins that downwardly project from the chamber adjacent to the inlet; and a scoop positioned proximate the inlet and between the first and second fins, the scoop being adjustable relative to the chamber.

* * * * *